US005171021A

United States Patent [19]

Orak

[11] Patent Number: 5,171,021

[45] Date of Patent: Dec. 15, 1992

[54] THROWING DEVICE

[76] Inventor: Zeki Orak, 4373 - 25th St., San Francisco, Calif. 94114

[21] Appl. No.: 789,096

[22] Filed: Nov. 7, 1991

[51] Int. Cl.[5] ..... A63B 65/00

[52] U.S. Cl. ..... 273/428

[58] Field of Search ..... 273/425, 428, 65, DIG. 20; 102/502, 503

[56] References Cited

U.S. PATENT DOCUMENTS

| | | | |
|---|---|---|---|
| 3,746,334 | 7/1973 | Stubblefield | 273/428 X |
| 3,982,489 | 9/1976 | Flatau et al. | 273/425 X |
| 4,251,079 | 2/1981 | Earl et al. | 273/428 |
| 4,262,579 | 4/1981 | Olson | 102/503 X |
| 4,790,788 | 12/1988 | Hill | 273/425 X |
| 4,805,535 | 2/1989 | Marcon | 102/503 |

*Primary Examiner*—Paul E. Shapiro
*Attorney, Agent, or Firm*—Limbach & Limbach;

[57] ABSTRACT

A throwing device which has an elongated body having an opening which completely extends through the throwing device forming a constant diameter air passageway, the air passageway being coaxial with the longitudinal axis of the throwing device. The elongated body is formed by joining two truncated substantially conical bodies. The throwing device is stabilized in flight by making the first conical body heavier than the second conical body and by making the second conical body longer and lighter than the first conical body. The first conical body has generally convex exterior lines and the second conical body has generally concave exterior lines.

4 Claims, 3 Drawing Sheets

THROWING DEVICE

FIELD OF THE INVENTION

The field of the present invention is a game ball. Specifically, the present invention is an elongated device which is designed to be thrown among participants in a game.

BACKGROUND OF THE INVENTION

An elongated device may be thrown among participants in a game in any number of ways. Aerodynamically, however, an elongated device is most efficiently thrown when the thrower can cause the elongated device to rotate about the longitudinal or major axis of the throwing device. An elongated device rotating stably about the major axis will have a longer flight and may be thrown with greater accuracy. To this end, several modifications to improve the rotational stability of throwing devices have been suggested.

U.S. Pat. Nos. 5,000,451 to MacDonald et al., 4,003,574 to MacDonald et al. and 3,884,446 to MacDonald et al. describe a football with an air passageway which tapers to a constricted opening midway through the passageway and various weighting methods to provide rotational stability.

U.S. Pat. No. 4,736,948 to Thomas teaches a football with fins attached to an air passageway to increase rotation of the ball.

In addition to footballs, other unusual oblong throwing devices have been suggested. U.S. Pat. Nos. 4,925,195 to DiManno and 4,339,138 to DiManno describe a throwing device with a gripping surface and an air passageway which tapers to a constricted opening midway through the passageway.

SUMMARY OF THE INVENTION

Accordingly, an object of the present invention is to increase the rotational stability of an elongated throwing device. The improved rotational stability as well as other benefits and advantages of the present invention may be more fully understood after an examination of the drawings and the detailed description of the preferred embodiment.

The present invention comprises an elongated throwing device which has increased rotational stability for a longer flight with greater accuracy. The increased rotational stability of the present invention is achieved by having a front section which is denser than a rear section, a shape which is substantially symmetrical about the major axis of the elongated body and substantially nonsymmetrical about an axis which is perpendicular to the major axis, and a constant-diameter air passageway which extends completely through the elongated body and which is coaxial with the major axis of the elongated body.

In the preferred embodiment, the elongated body is made of differing densities of rubber or a rubber and plastic combination. The elongated body is formed by joining two substantially conical bodies at the base. The conical bodies have been truncated at the apex with the front conical body being shorter and heavier than the rear conical body. The front conical body has generally convex exterior lines and the rear conical body has generally concave exterior lines.

The front conical body has a recessed cutout in the base. The center of the cutout is coaxial with the major axis and mates to a protrusion in the base of the rear conical body, the protrusion also being coaxial with the major axis.

DETAILED DESCRIPTION OF THE PREFERRED EMBODIMENTS

Figure 1:
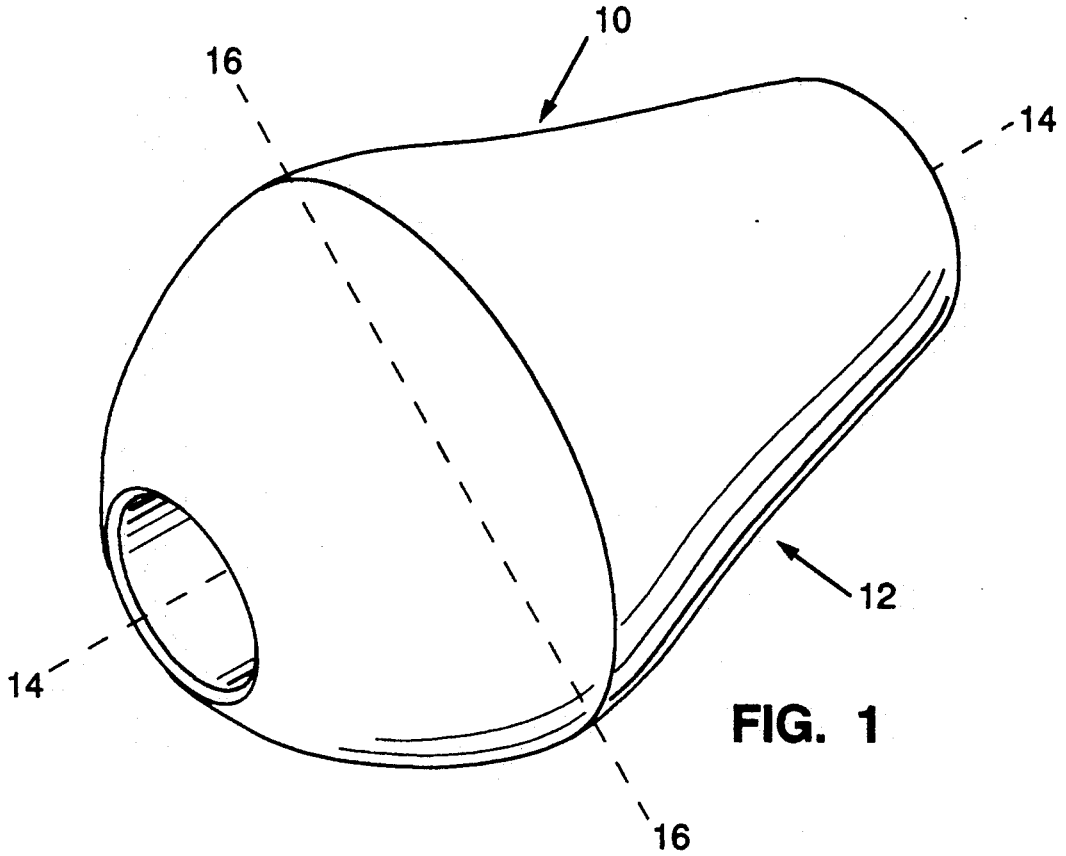
FIG. 1 is a perspective view of a throwing device according to the present invention.

FIG. 1 shows a perspective view Of the preferred embodiment of the throwing device 10 of the present invention. As illustrated, the throwing device 10 consists of a generally circular elongated body 12 which is substantially symmetrical about a major axis 14. In the preferred embodiment, the elongated body is 180 mm. in length. The throwing device 10 is substantially nonsymmetrical about an axis 16 which is perpendicular to the major axis 14.

Figure 2:
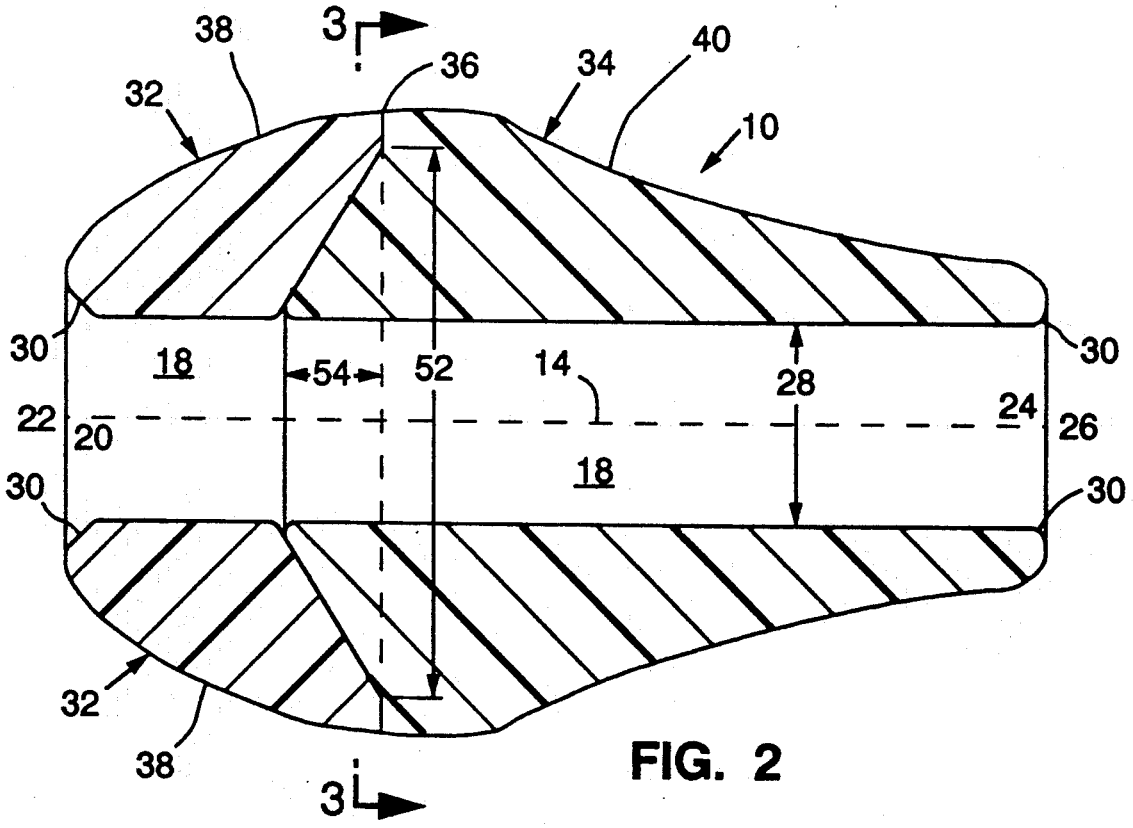
FIG. 2 is a cross-sectional view of the throwing device taken along line 2—2 of FIG. 3.
Figure 3:
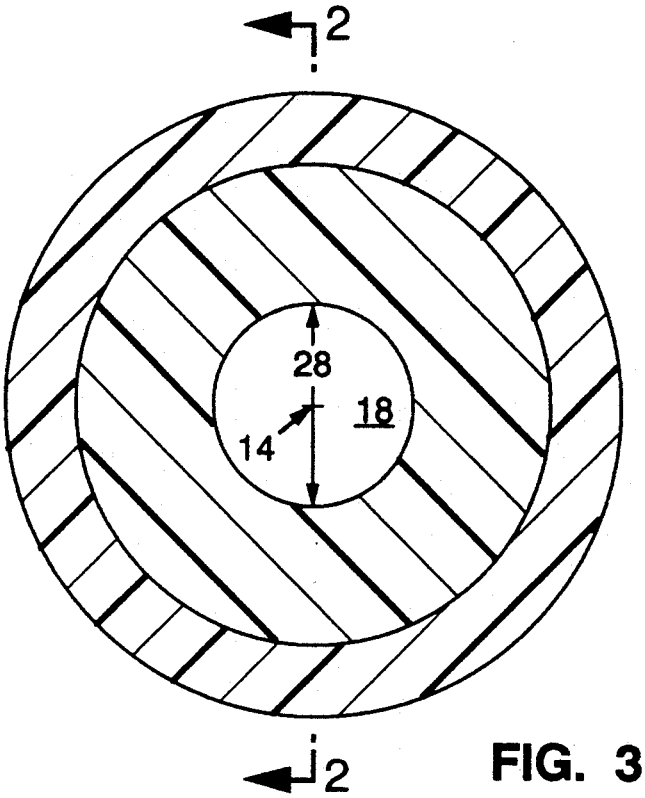
FIG. 3 is a transverse cross-sectional view of the throwing device taken along line 3—3 of FIG. 2.

As shown in FIG. 2, the throwing device 10 has a cylindrical air passageway 18 with a first opening 20 at the first end 22 and a second opening 24 at the second end 26. The cylindrical air passageway 18 extends completely through the throwing device 10 from the first end 22 to the second end 26 with a constant diameter 28. In the preferred embodiment, the constant diameter 28 is 37 mm. The cylindrical air passageway 18 is coaxial with the major axis 14. FIG. 3, illustrates this from a transverse cross-sectional point of view.

Referring again to FIG. 2, the first opening 20 and the second opening 24 are tapered 30 at the first end 22 and at the second end 26 with the taper at the first end 22 being larger than the taper at the second end 26.

It is believed that the cylindrical air passageway 18 will move the moment of inertia of the throwing device 10 further from the major axis 14. It is believed that this will increase the rotational stability of the throwing device 10.

In the preferred embodiment, the throwing device 10 is comprised of a front section 32 and a rear section 34. The front section 32 extends from the first end 22 to line 36. The rear section 34 extends from line 36 to the second end 26. The front section 32 and the rear section 34 have generally truncated conical bodies. The conical body of the front section 32 is shorter than the conical body of the rear section 34; the front section 32 being 58 mm. from the first end 22 to line 36 and the rear section 34 being 122 mm. from the second end 26 to the line 36. The diameter of the circular area represented by line 36 is 112 mm. The front section 32 has generally convex exterior lines 38 while the rear section 34 has generally concave exterior lines 40. This outer dimension in combination with the central opening defines an air foil configuration in cross-section and provides added lift for longer flight.

Figure 4:
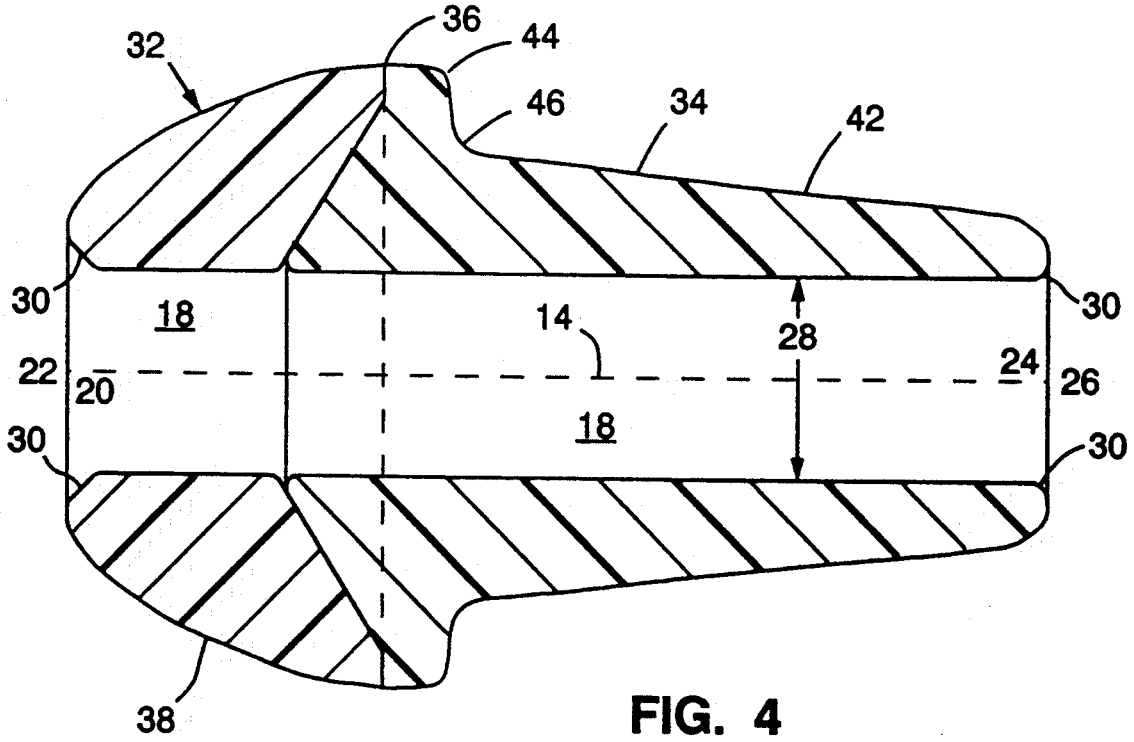
FIG. 4 is a cross-sectional view of an alternative throwing device.
Figure 5:
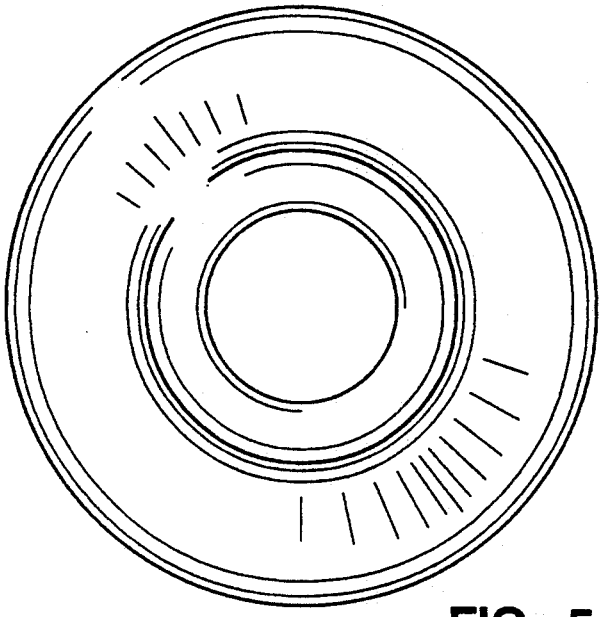
FIG. 5 is a view of the throwing device as viewed from the rear of the throwing device.

In an alternative embodiment, as shown in FIG. 4, the rear section 34 has exterior lines 42 which, after meeting the exterior lines of the front section 32 at line 36, gradually taper to point 44, where the exterior diameter is sharply tapered to point 46, then gradually taper to the second end 26. The exterior diameter at point 14 is 108 mm. and at point 46 is 84 mm. FIG. 5 illustrates this as viewed from the rear of the device.

Figure 6:
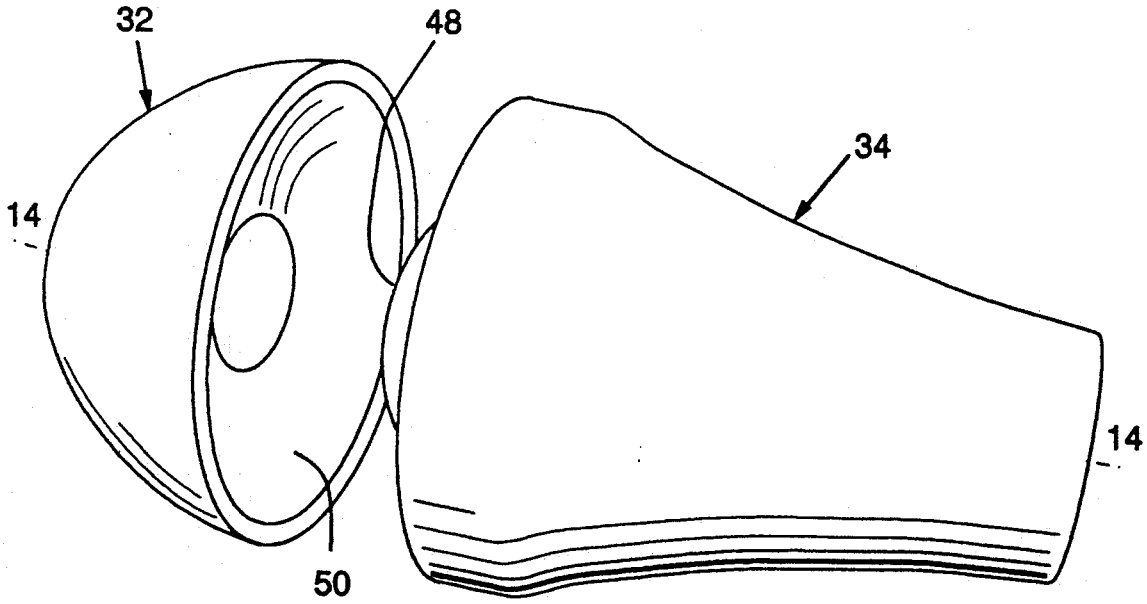
FIG. 6 is an exploded perspective view of a throwing device according to the preferred invention.

In the preferred embodiment, as shown in FIG. 6, the rear section 34 is joined to the front section 32 by permanently mating a protrusion 48 from the rear section 34 to a cutout 50 in the front section 32. The cutout 50 in the front section 32 and the protrusion 48 of the rear section 34 are coaxial with the major axis 14 and are circular in shape. Referring again to FIG. 2, the diameter 52 of the cutout 50 and the protrusion 48 is approximately 100 mm. The height 54 of the cutout 50 of the front section 32 and the protrusion 48 of the rear section 34 is 18 mm. The rear section 34 may be permanently mated to the front section 32 by any suitable adhesive.

Alternatively, the front section could be formed with a protrusion and mated to a rear section with a cutout.

In both the preferred and the alternative embodiments, the front section 32 is composed of a denser rubber material than the rear section 34 so that the front section 32 weighs more than the rear section 34. For example, the front section may be made of rubber or polyurethane and the rear section may be made of polyurethane or polystyrene. The throwing device 10 is composed of a rubber material to provide durability, a surface which is easy to grip when throwing, and flexibility so that the throwing device 10 may be caught with bare hands.

Alternatively, the rear section 34 can be made from molded plastic, making the rear section 34 hollow, as long as the front section 32 remains heavier than the rear section 34.

As described, the throwing device will be gripped about the widest portion and thrown front end first with a rotating motion similar to that used in throwing a football. The throwing device will have enhanced stability because the less dense rear section will be buffeted by the air, thereby reducing any wobble that was imparted by the thrower. In addition, the air foil configuration will increase the length of flight.

I claim:

1. A throwing device comprising:

an elongated body, said elongated body including a front section and rear section each having a conical configuration including a base and a truncated apex, with said front section being shorter than said rear section and having convex exterior line and with said rear section having generally concave exterior lines and with said front section having a density greater than said rear section, said body further including a circular opening which has a constant diameter and completely extends through said elongated body from said front section to said rear section, said opening being coaxial with said elongated body.

2. The throwing device as recited in claim 1 wherein said front section comprises a heavy rubber and said rear section comprises a light rubber.

3. The throwing device as recited in claim 1 wherein said front section comprises a rubber material and said rear section comprises a plastic material.

4. A throwing device as recited in claim 1 wherein said front section further includes a circular cutout from the base of said front section, said cutout being coaxial with said major axis, and said rear section further comprises a circular protrusion from said base of said rear section, said protrusion being coaxial with said major axis.

* * * * *